US005669462A

United States Patent [19]

Jennings

[11] Patent Number: 5,669,462

[45] Date of Patent: Sep. 23, 1997

[54] LADDER LEVELING APPARATUS

[76] Inventor: Paul J. Jennings, 28 Loyola Pl., Oakland, N.J. 07436

[21] Appl. No.: 617,645

[22] Filed: Mar. 19, 1996

[51] Int. Cl.[6] ..... E06C 7/44

[52] U.S. Cl. ..... 182/111; 182/204

[58] Field of Search ..... 182/111, 109, 182/204

[56] References Cited

U.S. PATENT DOCUMENTS

| | | | |
|---|---|---|---|
| 809,057 | 1/1906 | Hester | 182/204 |
| 2,146,759 | 2/1939 | Panowitz | 182/204 |
| 3,456,757 | 7/1969 | Sain | 182/111 |
| 3,998,293 | 12/1976 | Raia | 182/204 |
| 4,133,131 | 1/1979 | Davy | 248/528 |
| 4,236,603 | 12/1980 | Talley | 182/204 |
| 4,683,982 | 8/1987 | Baker | 182/204 |
| 5,305,851 | 4/1994 | Katson | 182/204 |

*Primary Examiner*—Alvin C. Chin-Shue
*Attorney, Agent, or Firm*—Michael I. Kroll

[57] ABSTRACT

An improved level ladder and safety device (10) for a ladder (12) of the type having a pair of side rails (14) with a plurality of connecting rungs (16). The device (10) comprises a pair of slider members (18), each of which is sized to fit against one of the side rails (14) of the ladder (12) at a lower end thereof in an adjustable manner. A facility (20) is for retaining each of the slider members (18) to each of the side rails (14) of the ladder (12), so that the ladder (12) can stand upright in a stationary safe position upon an uneven terrain (22).

1 Claim, 2 Drawing Sheets

Fig. 3
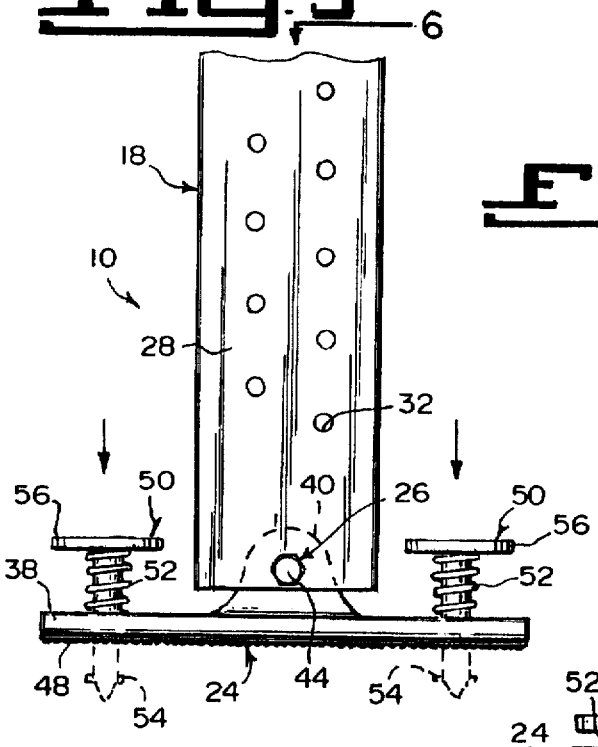
Fig. 4
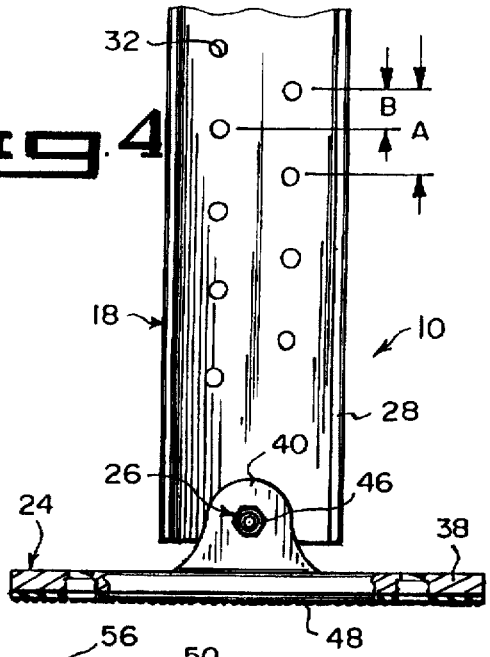
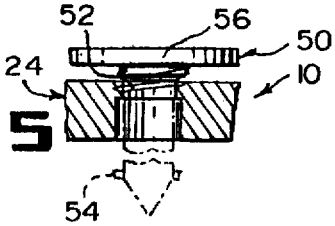
Fig. 5
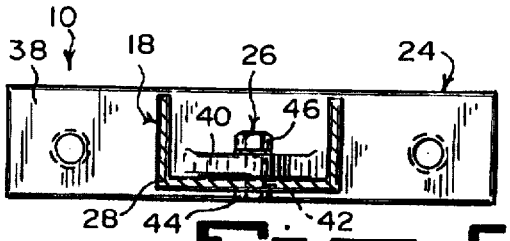
Fig. 6
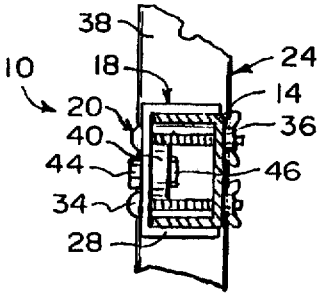
Fig. 7
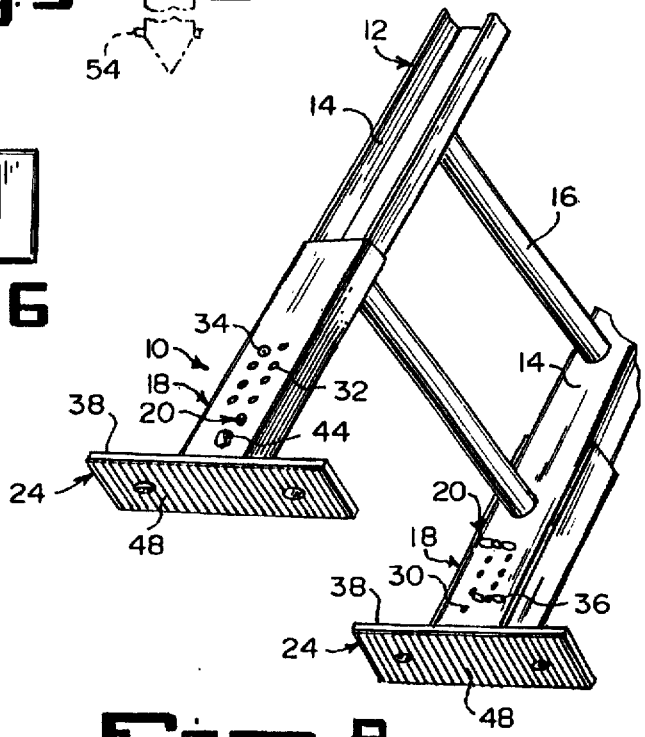
Fig. 8

LADDER LEVELING APPARATUS

BACKGROUND OF THE INVENTION

1. Field of the Invention

The instant invention relates generally to ladder accessories and more specifically it relates to an improved level ladder and safety device.

2. Description of the Prior Art

Numerous ladder accessories have been provided in prior art. For example, U.S. Pat. No. 4,683,983 to Murphy; U.S. Pat. No. 4,852,689 to Erion; U.S. Pat. No. 5,094,320 to Deitz et al. and U.S. Pat. No. 5,325,936 to Baker all are illustrative of such prior art. While these units may be suitable for the particular purpose to which they address, they would not be as suitable for the purposes of the present invention as heretofore described.

MURPHY, CHESTER M.

LADDER LEVELING APPARATUS

U.S. Pat. No. 4,683,983

Ladder leveling apparatus includes a frame portion, a support portion, a slider portion, a retainer portion and a positioner portion. The frame portion includes an elongated U-shaped section. The U-shaped section includes a main section having a width slightly larger than the width of a ladder leg. The main section includes at least one longitudinal channel. The support portion includes a foot member pivotally connected to the ladder leg. The foot member includes a connector section and a base section. The slider portion includes a guide member disposed within the channel, the guide member having a width slightly less than the width of the channel and a thickness slightly greater than the thickness of the main section. At least one opening extends through the guide member. The retainer portion includes a plate member disposed over the guide member, the plate member having a width significantly larger than that of the channel. An opening through the plate member is aligned with the guide opening. A bolt member extends through the plate and guide openings and extends beyond the main section a distance sufficient to pass through an opening through the thickness of the ladder leg. An adjustable fastener is disposed on the free end of the bolt member securing the ladder leg to the guide and plate members. The positioner portion includes a transverse pin member extending through aligned openings in the side sections.

ERION, GEORGE T.

LADDER LEVELING ACCESSORY

U.S. Pat. No. 4,852,689

A leveling device for a ladder which includes a pair of rails, hollow rungs spanning the rails, and foot members pivotally attached to lower portions of the rails. A channel shaped leveling accessory slides on a first one of the rails. Spaced openings are provided in a web of the channel shaped accessory. A selected opening can be aligned with a selected rung. An elongated pin is received in the selected opening and extends through the hollow rung. At end portions of the pin member outboard of the rails and outboard of the channel shaped accessory, fasteners are mounted in the pin member to hold the channel shaped accessory in position. An accessory foot is pivotally mounted on the accessory below the first mentioned rail. The foot members are arranged to support the ladder in an upright position.

DEITZ, BERNARD

SPECTOR, GEORGE

LADDER IMPROVEMENT

U.S. Pat. No. 5,094,320

A ladder leveling device for a ladder having a pair of side rails with connecting rungs is provided and consists of a pair of U-shaped channel members which are each slideably retained to each side rail. A securing mechanism locks each channel member in its adjustable position to enable the ladder to stand upright upon an uneven/inclined surface.

BAKER, GERALD

LADDER LEVELER

U.S. Pat. No. 5,325,936

A ladder leveler device to level and stabilize a ladder on an uneven surface, comprising a generally rectangular shaped base plate having a plurality of threaded holes located on each wide end. A plurality of hollow jack screws are complimentary to and thread through the plurality of threaded holes on each wide end. A plurality of Allen head bolts repose freely within the hollow jack screws. Washers and lock-nuts are on the plurality of Allen head bolts. A square tubular guide attaches longitudinally to the center of the rectangular shaped base plate. A square tubular shaft is slidable within the square tubular guide. A plurality of longitudinally aligned holes are in the center of one longitudinal side of the square tubular shaft. A restraint is on one end of the square tubular shaft. A longitudinal cut-out in the center of the side of the square tubular shaft is opposite the longitudinal side with the plurality of longitudinally aligned holes. A pivoting foot is secured to the square tubular shaft by means of a bolt, a plurality of spacers and a lock nut. A spring biased pin means is attached to the center of the square tubular guide having a circular shaft extending through the square tubular guide, the longitudinal cutout, the plurality of longitudinally aligned holes, and a complimentary hole on the square tubular guide opposite where the spring biased pin means is mounted.

SUMMARY OF THE INVENTION

A primary object of the present invention is to provide an improved level ladder and safety device that will overcome the shortcomings of the prior art devices.

Another object is to provide an improved level ladder and safety device that will compensate for uneven terrain when setting up a ladder, whereby the device will eliminate the common practice of using scraps of wood, rocks or bricks to level the ladder on a job site.

An additional object is to provide an improved level ladder and safety device in which the ladder can be adapted for use with the device by a person drilling the required matching holes in the side rails with a template for the device.

A further object is to provide an improved level ladder and safety device that is simple and easy to use.

A still further object is to provide an improved level ladder and safety device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF TEE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein;

FIG. 3 is a front elevational view taken in the direction of arrow 3 in FIG. 2, with parts broken away and the ladder removed.

FIG. 4 is a rear elevational view taken in the direction of arrow 4 in FIG. 2, with parts broken away and in section and the ladder and stakes removed.

FIG. 5 is an enlarged cross sectional view with parts in phantom and broken away taken along line 5—5 in FIG. 2.

FIG. 6 is a top view taken in the direction of arrow 6 in FIG. 3, with the stakes removed.

FIG. 7 is a top view taken in the direction of arrow 7 in FIG. 2, with parts of the shoe broken away and the stakes removed.

FIG. 8 is a bottom perspective view taken in the direction of arrow 8 in FIG. 2, with the stakes removed.

Similar reference characters denote corresponding features consistently throughout the attached drawings.

DETAILED DESCRIPTION OF THE PREFERRED EMBODIMENTS

Figure 1:
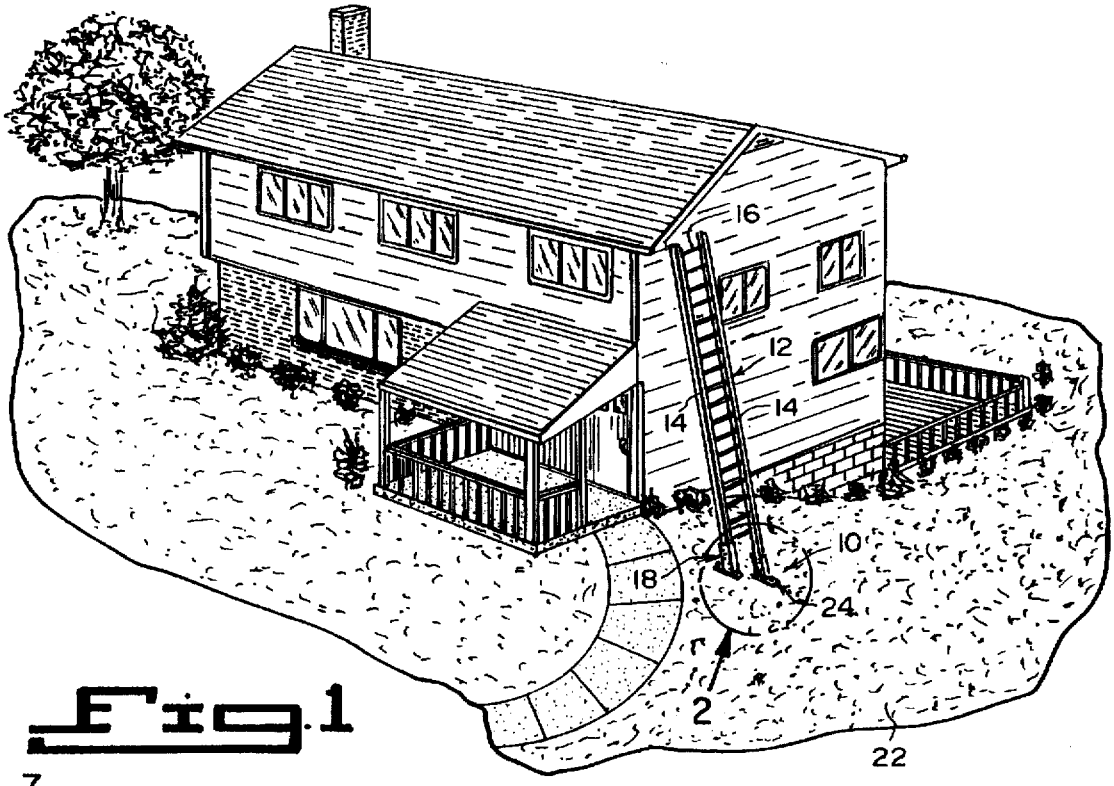
FIG. 1 is a perspective view showing a ladder against a house with the instant invention installed on the ladder in use.
Figure 2:
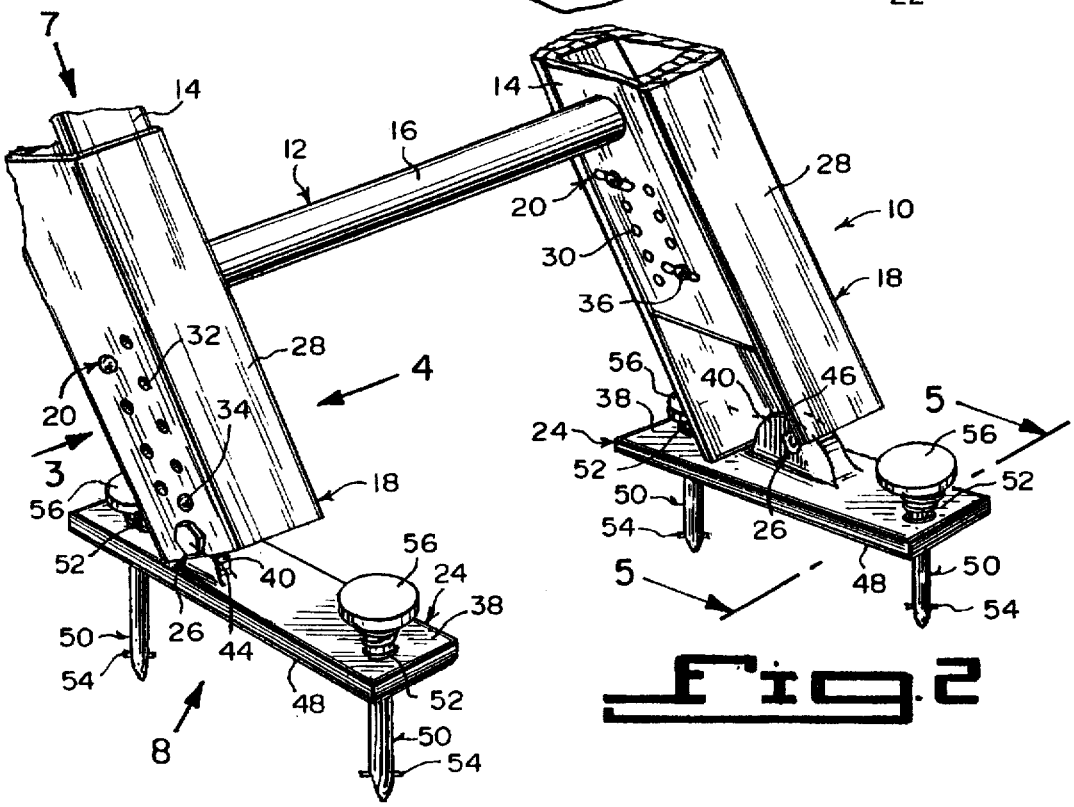
FIG. 2 is an enlarged perspective view of the area indicated by arrow 2 in FIG. 1.

Turning now descriptively to the drawings, in which similar reference characters denote similar elements throughout the several views, FIGS. 1 through 8 illustrate an improved level ladder and safety device 10 for a ladder 12, of the type having a pair of side rails 14 with a plurality of connecting rungs 16. The device 10 comprises a pair of slider members 18, each of which is sized to fit against one of the side rails 14 of the ladder 12 at a lower end thereof in an adjustable manner. A facility 20 is for retaining each of the slider members 18 to each of the side rails 14 of the ladder 12, so that the ladder 12 can stand upright in a stationary safe position upon an uneven terrain 22.

The improved level ladder and safety device 10 further contains a pair of self leveling shoes 24. A structure 26 is for pivotally securing each shoe 24 to a bottom end of one slider member 18, so that the shoes 24 will stabilize the ladder 12 upon the uneven terrain 22. Each slider member 18 is a channel 28 U-shaped in cross section, having a width slightly wider than the width of each side rail 14 of the ladder 12, so as to fit up against the side rail 14.

The retaining facility 20 includes each side rail 14 of the ladder 12, having a plurality of vertical spaced apart holes 30 therethrough at the lower end thereof. Each slider member 18 has a plurality of vertical spaced apart apertures 32 therethrough, which match up with the holes 30 in the side rail 14. Four bolts 34 are provided. Two bolts 34 will fit through two apertures 32 in one slider member 18 and into two holes 30 in the side rail 14. Four wing nuts 36 are also provided. Two wing nuts 36 will thread onto two ends of two of the bolts 34.

The holes 30 in the side rails 14 and the apertures 32 in the slider members 18 are staggered, so as to form two vertical rows in which one row is centrally offset from the other row, to allow for a finer adjustment setting for the slider members 18 to the side rails 14. Each said shoe 24 includes a flat rectangular plate 38 having a central lug 40 extending upwardly therefrom. The holes 30 in the side rails 14 can be made by a template (not shown), which matches up with the pattern of apertures 32 in the slider members 18.

The pivotally securing structure 26 consists of each slider member 18 having a lower central bore 42 therethrough. A pair of bolts 44 are provided. Each bolt 44 fits through one bore 42 and one lug 40. A pair of nuts 46 are also provided. Each nut 46 threads onto one end of one bolt 44, thereby allowing each shoe 24 to pivot.

Each shoe 24 contains an anti-skid pad 48 affixed to the underside thereof, to prevent slippage of the shoe 24 upon the uneven terrain 22. Each shoe 24 includes a pair of stakes 50 which extend therethrough to enter into the uneven terrain 22, so as to help keep the shoe 24 stationary upon the uneven terrain 22.

Each stake 50 contains a spring 52 thereon to spring bias the stake 50, so as to normally keep the stake 50 in an upward position on the shoe 24, when the stake 50 is not driven into the uneven terrain 22. A stop pin 54 is transversely driven through a lower end of the stake 50, so as to prevent the stake 50 from leaving the shoe 24 when in the upward position.

The improved level ladder and safety device 10 can be used on any type of ladder 12, such as one made of wood, aluminum or fiberglass. Each stake 50 has a large flat head 56. The large flat head 56 will enable a person to step on it and a hammer to strike it, so as to drive the stake 50 into the uneven terrain 22. The large flat head 56 will also allow the stake 50 to be easily pulled out from the uneven terrain 22.

LIST OF REFERENCE NUMBERS

10 improved level ladder and safety device
12 ladder
14 side rail of 12
16 rung of 12
18 slider member of 10
20 retaining facility of 10
22 uneven terrain
24 self leveling shoe of 10
26 pivotally securing structure of 10
28 U-shaped channel
30 hole in 14
32 aperture in 18
34 bolt of 20
36 wing nut of 20
38 flat rectangular plate of 24
40 central lug on 38
42 lower central bore in 18
44 bolt of 26
46 nut of 26
48 anti-skid pad of 24
50 stake of 24

52 spring on 50
54 stop pin in 50
56 large flat head of 50

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A ladder comprising:

a) a pair of spaced and parallel side rails with a plurality of spaced connecting rungs;

b) a slider member fitted on each of the side rails of the ladder at a lower end thereof in an adjustable manner, each said slider member being a channel U-shaped in cross section having a width slightly wider than the width of each side rail so as to fit up against the side rail;

c) means for retaining each said slider member to each of the side rails of the ladder comprising in each rail a plurality of holes therethrough vertically arranged and spaced apart at the lower end thereof, each said slider member having a plurality of vertical spaced apart apertures therethrough, staggered and in two vertical rows, matching up with said holes in the side rail, two bolts passing through two apertures in each slider member and two holes in the side rail, and a wing nut for each of said bolts threaded into the end of each bolt for locking each bolt in place;

d) a self leveling shoe on the bottom of each slider member comprising a rectangular plate with a central lug extending upwardly therefrom and an anti-skid pad affixed to the underside of each plate, each said slider member having a lower central bore therethrough, a bolt for each slider member fitted through each central bore and the central lug with a nut threaded onto one end of each bolt allowing each said shoe to pivot; and e) each self leveling shoe having a pair of stakes extending therethrough on opposite sides of the central lug to enter an uneven terrain for helping to keep the shoe stationary, each stake having an enlarged flat head at the top thereof above the top of said shoe and including a bias spring between said flat head and the top surface of said shoe to normally keep said stake in an upward position on said shoe when said stake is not driven into the uneven terrain, and a permanently mounted stop pin transversely driven through a lower end of said stake extending out of the bottom side of said shoe to prevent said stake from leaving said shoe when in the upward position, said flat head being large enough to allow the stake to be easily pulled out from the uneven terrain.

* * * * *